United States Patent [19]

Swaving et al.

[11] Patent Number: 4,990,823

[45] Date of Patent: Feb. 5, 1991

[54] ELECTRON GUN AND METHOD OF MANUFACTURING AN ELECTRON GUN, AND DISPLAY TUBE COMPRISING SUCH AN ELECTRON GUN

[75] Inventors: Erland C. J. Swaving; Paul J. Van Rijswijck, both of Eindhoven, Netherlands

[73] Assignee: U. S. Philips Corporation, New York, N.Y.

[21] Appl. No.: 408,983

[22] Filed: Sep. 18, 1989

[30] Foreign Application Priority Data

Sep. 22, 1988 [NL] Netherlands ..... 8802344

[51] Int. Cl.[5] ..... H01J 9/18; H01J 29/46

[52] U.S. Cl. ..... 313/446; 313/451; 313/456; 445/29; 445/36; 445/51

[58] Field of Search ..... 313/446, 451, 456, 346 R, 313/346 DC, 337; 445/29, 33, 35, 36, 51

[56] References Cited

U.S. PATENT DOCUMENTS 2,732,512 1/1956 Briggs, Jr. ..... 313/446

4,403,169 9/1983 Blanken ..... 313/446

*Primary Examiner*—Kenneth Wieder

*Attorney, Agent, or Firm*—Robert J. Kraus

[57] ABSTRACT

The invention relates to an electron gun comprising a cathode-unit composed of a cathode shaft (53) which is surrounded by a heat reflection screen (56). A connection piece (55) is secured to the head end of the cathode shaft (53). A holder (59) containing electron-emitting material (60) is located on the connection piece (55). The cathode shaft (53) is suspended in the heat reflection screen (56) by means of suspension wires (57), each wire being secured to the heat reflection screen with one end which is at least close to the head end of the heat reflection screen (56), and the other end (58) being located between the connection piece (55) and the holder (59).

11 Claims, 6 Drawing Sheets

ELECTRON GUN AND METHOD OF MANUFACTURING AN ELECTRON GUN, AND DISPLAY TUBE COMPRISING SUCH AN ELECTRON GUN

BACKGROUND OF THE INVENTION

The invention relates to an electron gun for generating an electron beam, comprising a cathode unit composed of a cathode shaft which is surrounded by a heat reflection screen, which cathode shaft is secured to a holder containing electron-emitting material having an emissive surface.

The invention also relates to a method of manufacturing an electron gun comprising a cathode unit, in which a cathode shaft is suspended in a heat reflection screen and a holder containing electron-emitting material is secured to the head end of the cathode shaft, and to a display tube having such an electron gun.

An electron gun of the type mentioned in the opening paragraph is used in black-and-white and colour display tubes for television and data display, in camera tubes and other tubes in which an electron beam is to be generated. The life of such tubes is largely determined by the life of the electron gun, which is governed by, inter alia, the life of the cathode unit of the electron gun and the suspension of the cathode unit in the heat reflection screen. Moreover, it should be possible to mass-produce accurately an electron gun, in particular the cathode unit, having a short warm-up time. The present developments in the field of electron guns are aimed at meeting these requirements. However, it has been found in practice that the electron guns known so far still have several disadvantages.

An electron gun of the type mentioned in the opening paragraph is known from U.S. Pat. No. 4,403,169 (PHN 9733). In the Patent Specification a description is given of an electron gun in which the cathode shaft is suspended in the heat reflection screen so as to be self-supporting by means of relatively long metal wires one end of which is secured to the end of the cathode shaft near the emissive surface and the other end is secured to a cathode support member which is located outside the reflection screen. In practice it has been found, however, that the operation and the life of the electron gun are sensitive to vibrations.

SUMMARY OF THE INVENTION

It is an object of the invention, inter alia, to provide an electron gun having a long life cycle, and its operation being substantially insensitive to vibrations.

To this end, an electron gun of the type mentioned in the opening paragraph is characterized in accordance with the invention in that a connection piece is secured to the head end of the cathode shaft, the holder being provided on said connection piece and the cathode shaft being suspended in the heat reflection screen by means of wires, a part thereof being secured to the head end of the heat reflection screen, and another part being secured between the connection piece and the holder.

The invention is based on the insight that the sensitivity to vibrations of the known electron gun is caused by the construction in which relatively long suspension wires are used. The sensitivity to vibrations is reduced considerably by the construction according to the invention. As the suspension wires are secured to the head end of the reflection screen, they can be shorter than the known suspension wires, so that the suspension according to the invention is less sensitive to vibrations. Moreover, this construction enables the cathode shaft to be arranged completely inside the heat reflection screen, which results in a high thermal efficiency. Moreover, the wires can be readily secured and the cathode shaft can be suspended in the heat reflection screen in an accurate and stable manner by means of a mechanised production process. Due to the increased thermal efficiency, an electron beam can be obtained at a small cathode dissipation, thereby extending the life cycle of the electron gun.

The thermal efficiency of an electron gun is increased further in a preferred embodiment of an electron gun in accordance with the invention, which is characterized in that the holder of the electron-emitting material is at least partly located inside the heat reflection screen. Due to this, heat loss as a result of radiation by the holder of the electron-emitting material is at least partly prevented by the heat reflection screen. The heat radiated is reflected to the cathode shaft, which results in a shorter warm-up time.

The cathode unit of an electron gun attains a high temperature during operation. Consequently, the parts used for the cathode unit are preferably composed of heat-resistant material such as, for example, molybdenum. A disadvantage of these heat-resistant materials is, however, that it is often very difficult to secure a part to these materials, for example, by means of welding. Amongst other problems, undesired cracking sometimes occurs at the location of a weld.

A further preferred embodiment of an electron gun in accordance with the invention is characterized in that the cathode shaft is provided on the inside with a layer of aluminium having a thickness between 1 and 10 $\mu$m. In practice it has been found that during the welding of, for example, the connection piece to the cathode shaft, cracking is prevented in a sufficiently large number of cases.

A further preferred embodiment of an electron gun in accordance with the invention, characterized in that the wall of the connection piece has a larger thickness than that of the cathode shaft, enables the connection piece to be properly secured to the cathode shaft by means of laser welding. In practice it has been found that a very suitable wall thickness of the connection piece is approximately twice the wall thickness of the cathode shaft.

Another preferred embodiment of an electron gun in accordance with the invention is characterized in that the suspension wires are manufactured from a material having a low coefficient of thermal conductivity of between 40 and 60 $Wm^{-1}K^{-1}$ at approximately 1300° K. In this way, large thermal leaks between the cathode shaft and the heat reflection screen are precluded.

Because of the heat resistance of the cathode unit and to preclude adverse effects caused by differences in coefficients of thermal expansion, the cathode shaft, the connection piece and the holder are preferably predominantly made of molybdenum.

To minimise cost it is desirable that the manufacture of an electron gun be readily mechanised. For this reason, and taking into account accuracy and speed, the parts are secured to one another, preferably, by means of a laser. This object is achieved in an inventive method of manufacturing an electron gun having a cathode unit, in which a cathode shaft is suspended in a heat reflection screen and a holder containing an electron-emitting material is secured to the head end of the cathode shaft, which method is characterized in that a connection piece is secured to the head end of the cathode shaft, and in that the cathode shaft is suspended in the heat reflection screen by securing suspension wires to the head end of the heat reflection screen, contacting the connection piece and the holder in such a manner that parts of the suspension wires extend between the holder and the connection piece, and interconnecting the holder, the wire parts and the connection piece.

A preferred embodiment of a method according to the invention is characterized in that the cathode shaft is formed by wrapping or forming a unilaterally aluminized foil around a mandrel, in such a manner that an at least partial overlap is obtained, and interconnecting the overlapping parts of the cathode shaft at the end of the cathode shaft facing away from the head end. In this manner, a cathode shaft is obtained which enables, inter alia, the connection piece to be secured thereto in a simple manner by means of laser welding.

A further preferred embodiment of a method according to the invention is characterized in that after the holder has been connected to the connection piece the cathode shaft is pushed into the heat reflection screen until the suspension wires are plastically deformed. The sensitivity to vibrations of the suspension is reduced by the plastic deformation of the suspension wires, which renders the suspension wires less elastic.

A display tube having an electron gun in accordance with the invention has a relatively long life cycle.

BRIEF DESCRIPTION OF THE DRAWING

The invention will now be explained in greater detail by means of a few exemplary embodiments and with reference to the drawing, in which.

DESCRIPTION OF THE PREFERRED EMBODIMENTS

Figure 1:
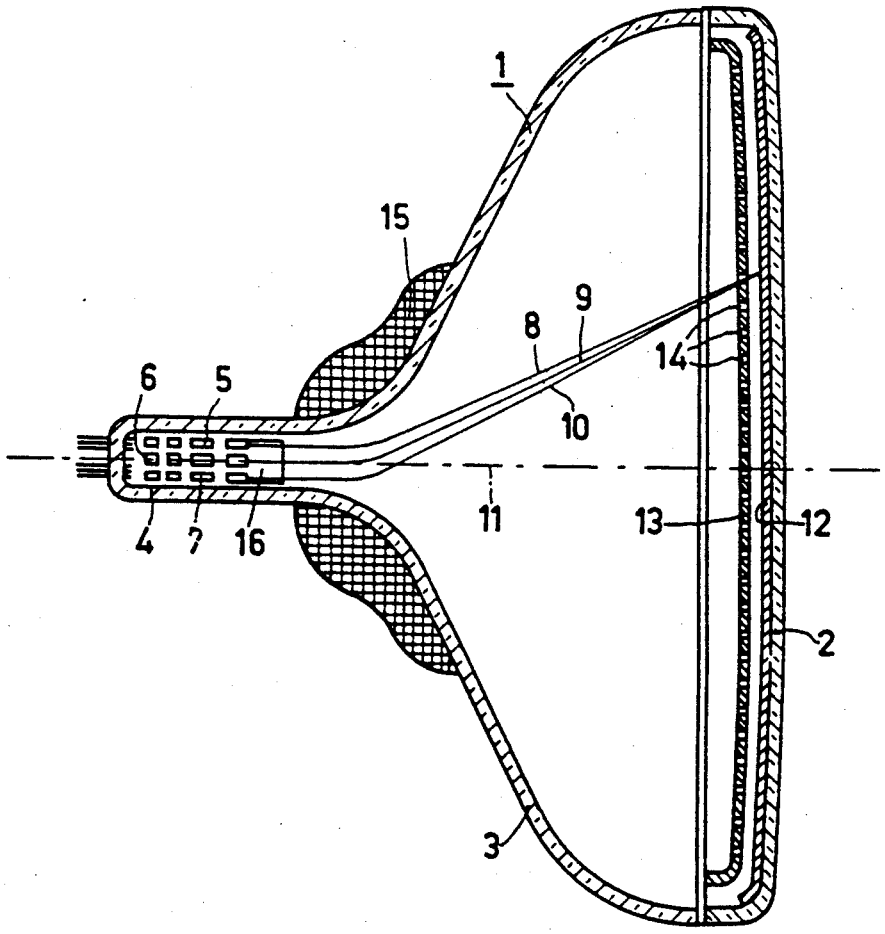
FIG. 1 is a diagrammatic, sectional view of a cathode ray tube comprising an electron gun in accordance with the invention.

FIG. 1 is a sectional view of a display tube comprising an electron gun in accordance with the invention, in the present case a colour display tube of the "in-line" type. However, the invention can also be applied to camera tubes, black-and-white television display tubes and other tube types in which an electron beam must be generated. These electron guns 5, 6 and 7 which generate the electron beams 8, 9 and 10, respectively, are provided in a neck 4 in a glass envelope 1 which is composed of a display window 2, a funnel shaped part 3 and said neck 4. The axes of the electron guns are located in one plane, the plane of the drawing. The axis of the central electron gun 6 substantially coincides with the axis 11 of the tube. The three electron guns open into a sleeve 16 which is situated coaxially in the neck 4. The display window 2 is provided on the inside with a large number of triads of luminescing phosphor elements. The phosphor element may be in the form of, for example, dots or strips. By way of example, the invention will be described further by means of strip-shaped elements the longitudinal direction of which extends perpendicularly to the plane through the electron guns (in this case the plane of the drawing). All triads together form a display screen 12. A shadow mask 13 comprising a very large number of elongate apertures 14 through which the electron beams 8, 9 and 10 pass is provided in front of the display screen 12. The electron beams are deflected in the horizontal direction (in the plane of the drawing) and in the vertical direction (at right angles to the plane of the drawing) by the system of deflection coils 15. The three electron guns are mounted so that their axes enclose a small angle with one another, the so-called colour selection angle. Due to this the electron beams pass through the apertures 14 at that angle and each beam impinges only on phosphor elements of one colour.

Figure 2:
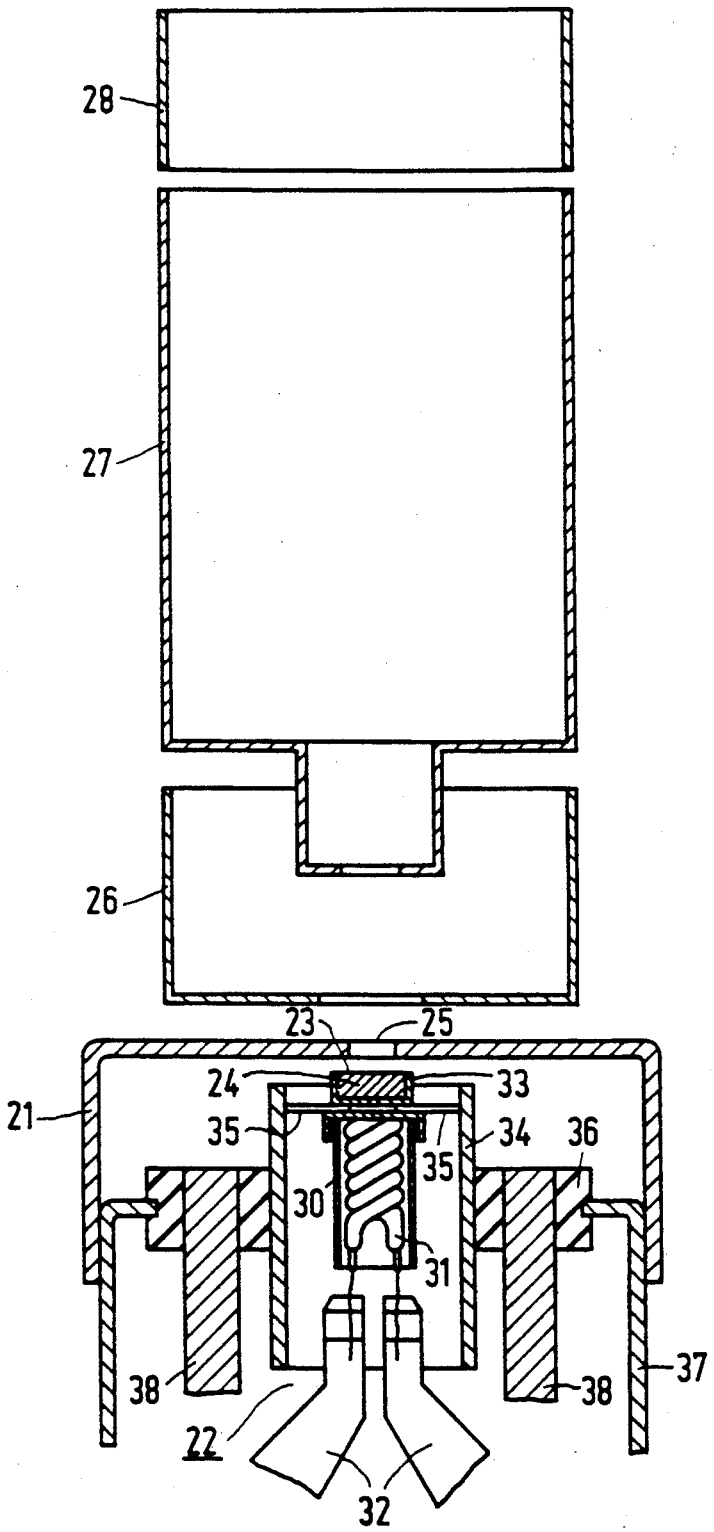
FIG. 2 is a diagrammatic sectional view of an electron gun in accordance with the invention.

FIG. 2 is a longitudinal sectional view of one of the electron guns of FIG. 1 in accordance with the invention. A cathode unit 22 is positioned in the metal part 21 having an aperture 25. The cathode unit 22 comprises an electron-emitting material 24, for example an impregnated tungsten emitter body having an emissive surface 23. The electron beam generated passes through an aperture 25 in the first grid electrode 21 and is then accelerated and focused by means of the grid electrodes 26, 27 and 28. In a colour display tube the cathode potential is, for example, +30 Volts, the first grid electrode 21 has a potential of, for example 0 Volt, the second grid electrode 26 has a potential of 1000 Volts, the third grid electrode 27 has a potential of 6000 Volts and the fourth grid electrode 28 has a potential of 27 kVolts. The operation of the first grid electrode 21 depends on the distance from the emissive surface 23 to said electrode 21. Consequently, it is obvious that thermal expansion of the cathode shaft 30 must have no influence on the distance from the cathode to the first grid. Such a cathode unit 22 may, of course, also be used in a diode electron gun (for example, in television camera tubes). In a diode electron gun the cathode is succeeded by an anode which is at a positive voltage. Also in such a diode electron gun the distance from the cathode to the anode must remain constant.

The cathode unit 22 comprises a heating wire 31 within the cathode shaft 30 which is coated with blackened aluminium oxide and which is connected to connection strips 32. The electron-emitting material 24 is present in a holder 33. The cathode shaft 30 is suspended in a heat reflection screen 34 by means of suspension wires 35. This heat reflection screen 34 is enveloped by an electrically insulating ceramic body 36 in an assembly cylinder 37. Two pins 38 to which the connection strips 32 for the heating wire 31 are spot-welded are provided in the ceramic body 36.

Figure 3:
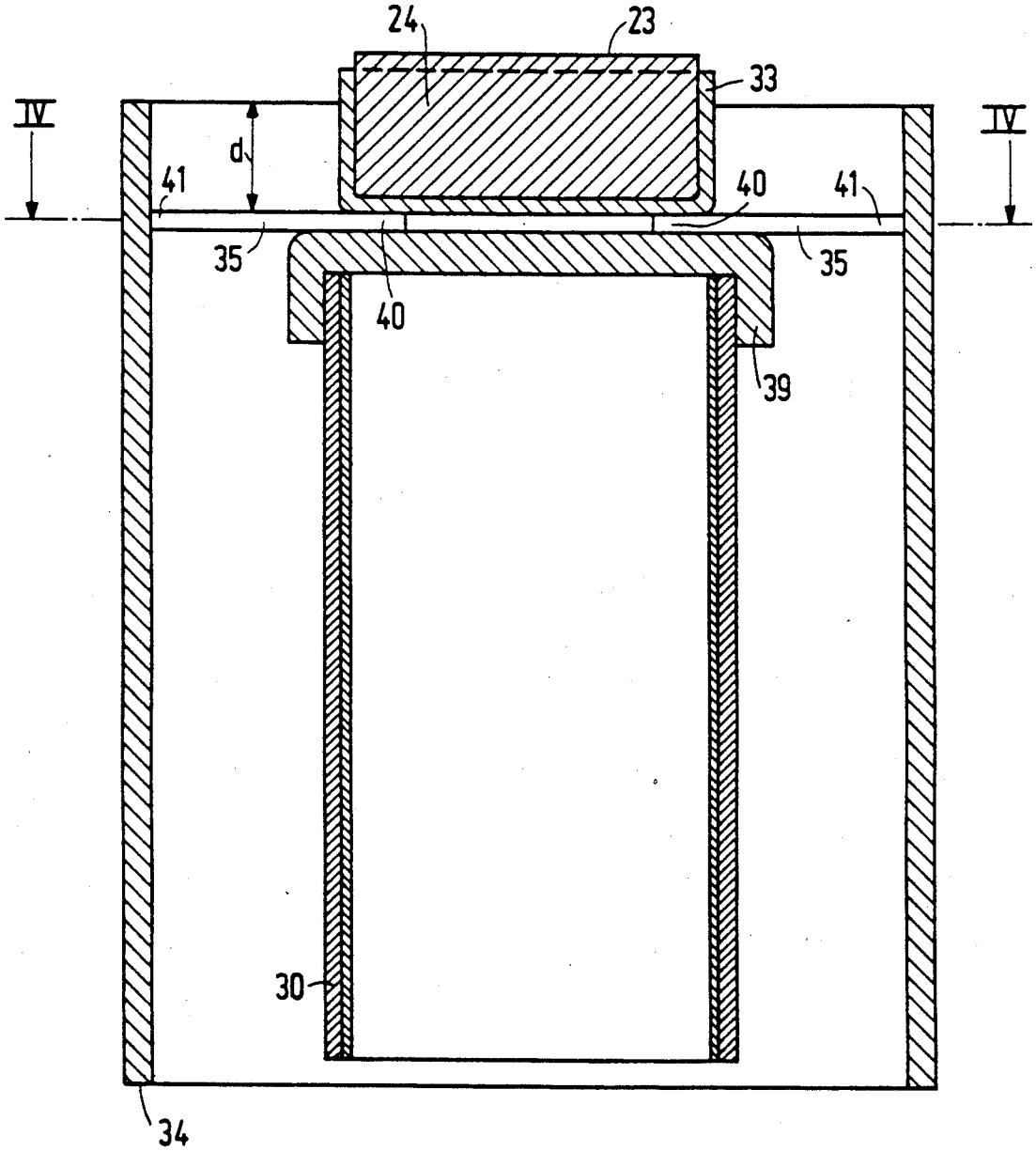
FIG. 3 is a diagrammatic sectional view of a detail of FIG. 2.

FIG. 3 is a sectional view of a detail of FIG. 2, which clearly shows how the cathode shaft 30 is suspended in the heat reflection screen 34. The invention will be described further by means of a cup-shaped connection piece. Said connection piece may be differently shaped, however, for example flange-shaped. A connection piece 39 is secured to the end of the cathode shaft 30 which is in the vicinity of the emissive surface, and which is hereinafter termed head end. The holder 33 comprising the electron-emitting material 24 is located on the connection piece 39. Disposed between the connection piece 39 and the holder 33 there is a part 40 of a suspension wire 35, the end 41 of which is secured to the heat reflection screen 34 near the end of said screen which is in the vicinity of the emissive surface (the head end). By virtue hereof, the length of the suspension wires, which is of the order of half a millimeter, is sufficiently small to render the suspension substantially insensitive to the customarily occurring vibrations. The end 41 may be secured to the edge of the heat-reflection screen 34 or at a small distance from said edge. In the description, the place of attachment will hereinafter be termed head end of the screen 34.

Moreover, this enables the cathode shaft 30 to be located entirely inside the heat reflection screen 34. The thermal efficiency of the cathode unit is increased in that substantially all heat radiated during operation of the cathode unit is reflected by the heat reflection screen 34. In the embodiment shown the thermal efficiency is further increased by the holder 33 of the emitting material being partly located inside the heat reflection screen. In the embodiment shown, the degree to which the holder 33 is located inside the heat reflection screen 34, and hence the thermal efficiency of the cathode unit, can be adjusted as a function of the distance d, which is the distance between the edge of the heat reflection screen 34 and the location where the suspension wires 35 are secured to the heat reflection screen 34.

To limit heat conduction between the cathode shaft 30 and the heat reflection screen 34, so that no major thermal leaks can occur, the suspension wires 35 are preferably manufactured from a material having a low coefficient of thermal conductivity, under normal operating conditions between 40 and 60 $Wm^{-1}K^{-1}$ at approximately 1300° K.

Such a material is preferably an alloy of tungsten and approximately 26% by weight of rhenium, an alloy of molybdenum and approximately 41% by weight of rhenium or an alloy of tantalum and neobium.

Figure 4:
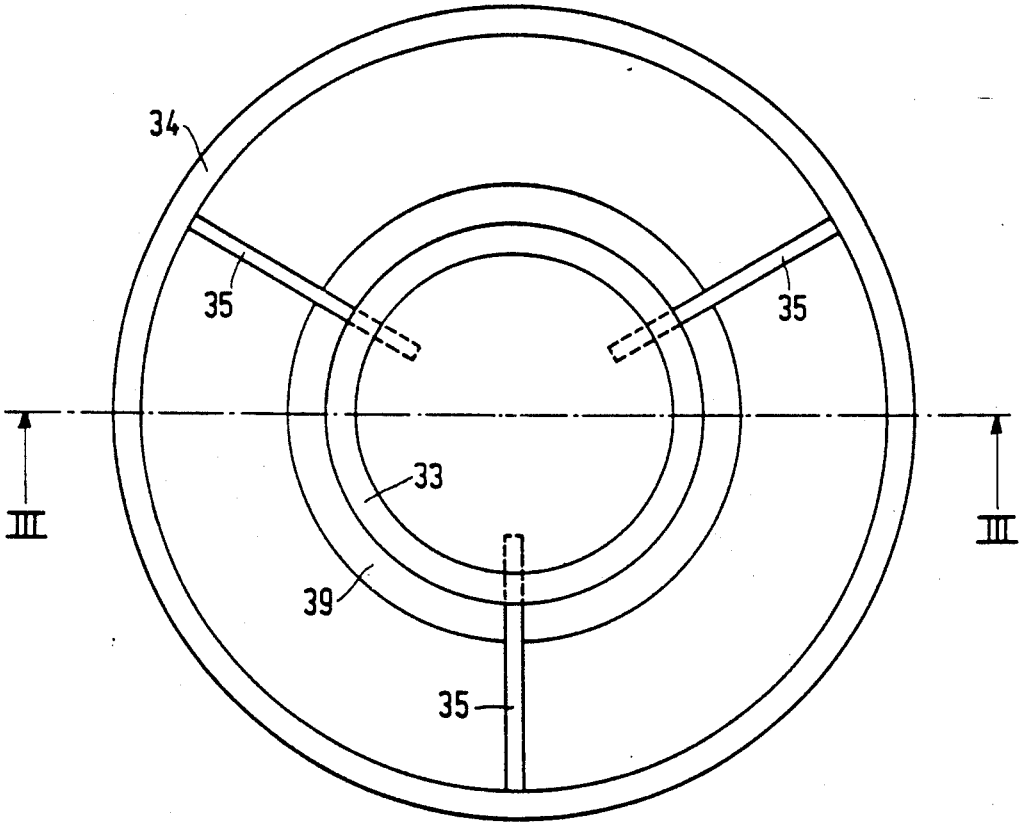
FIG. 4 is a diagrammatic front view of the detail of FIG. 3 in the direction of the arrows IV, FIGS. 5*a* and 5*b* diagrammatically show the formation of the cathode shaft, FIG. 6 diagrammatically shows how the connection piece is connected.

The cathode unit is rendered even more insensitive to vibrations by stretching the suspension wires 35, which will be explained by means of FIG. 10. FIG. 4 is a diagrammatic front view of a detail of FIG. 3. In this exemplary embodiment the cathode shaft is suspended in the heat reflection screen 34 by means of three suspension wires 35. Due to the fact that the distance from the emissive surface 23 to the location where the suspension wires 35 are secured in the heat reflection screen 34 is small, the change in position of the emissive surface as a result of thermal expansion of the holder 33 and the suspension wires 35, caused by changes in temperature, remains sufficiently small. On account of this, the position of the emissive surface 23 remains substantially constant throughout the life cycle.

During operation some parts of the cathode unit may reach a temperature of approximately 1300° K. The cathode shaft 30, the connection piece 39 and the holder 33 preferably substantially consist of a heat-resistant material such as, for example, molybdenum so that a sufficiently high thermal resistance is obtained.

In practice it has been found that, for example, the connection piece 39 can be secured to the cathode shaft 30 in a desirable manner, if they are made of a heat-resistant material, by providing the inside of the cathode shaft with a layer of aluminium having a thickness between 1 and 10 μm, for example 2 μm. It has been found that the aluminium substantially precludes the formation of cracks in the weld.

In practice it has been found that when the wall of the connection piece 39 has a greater thickness than that of the cathode shaft 30, the connection piece 39 can be readily and solidly secured to the cathode shaft 30 by means of laser welding. Very good results were obtained when the wall thickness of the connection piece 39 was approximately twice as thick as that of the cathode shaft.

The accurate manufacture of an electron gun in accordance with the invention in a mechanised production process will be described by means of FIGS. 5 up to and including 9.

Figure 5A:
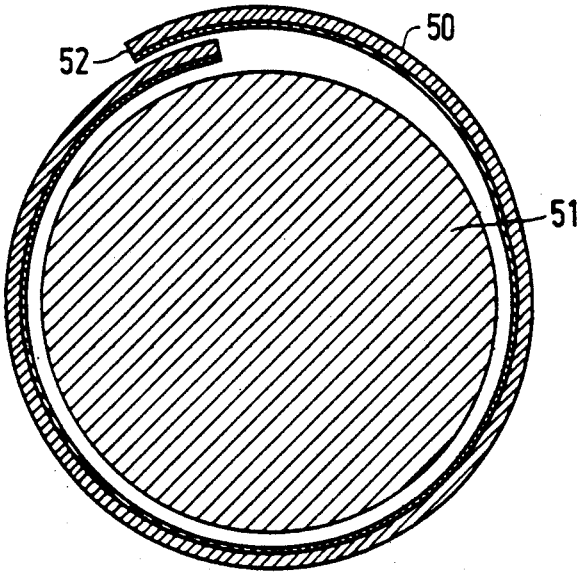
Figure 5B:
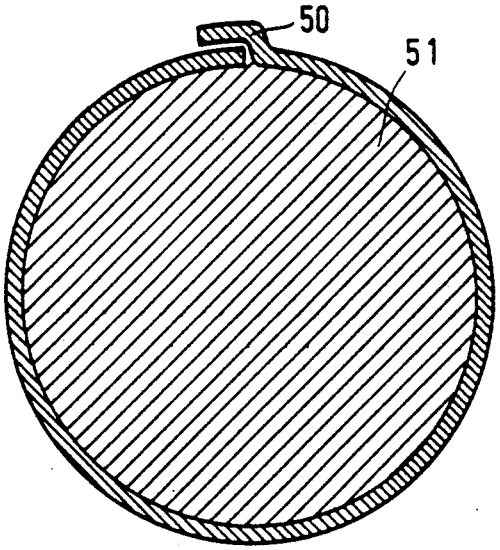
Figure 6:
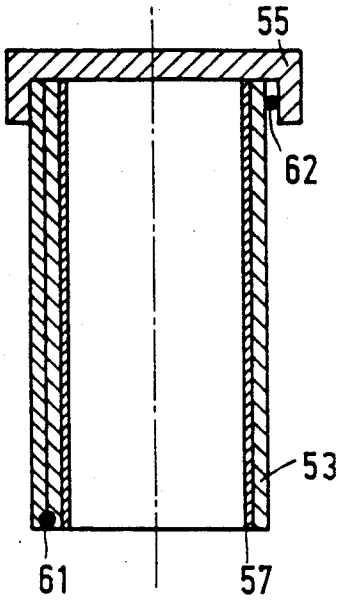

The manufacture of the cathode shaft is diagrammatically shown in FIGS. 5A and B. A foil 50 of molybdenum or another heat-resistant material which is unilaterally provided with a layer 52 of aluminium is wrapped or drawn around a mandrel 51 in such a manner that an at least partial overlap is obtained. The foil 50 which has a thickness of, for example, 30 μm adopts the shape of the mandrel 51. In the present embodiment, the overlapping parts are welded to each other (see FIG. 6) at one end 61 of the cathode shaft 53 thus formed.

Figure 7:
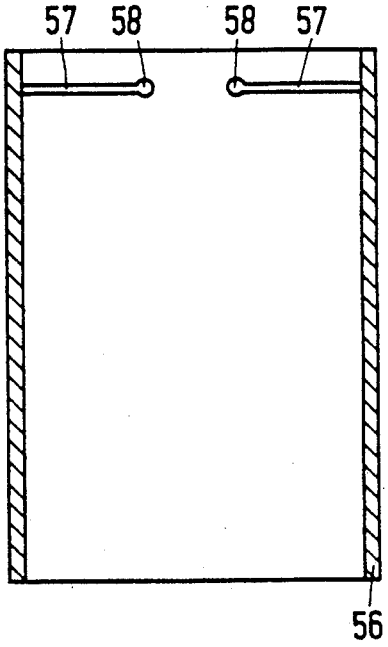
FIG. 7 shows how the suspension wires are secured to the heat reflection screen.

Subsequently, a connection piece 55 which is cup-shaped in the present embodiment and which is manufactured from, for example, molybdenum, is located at the head end of the cathode shaft 53. Since the overlapping parts of the cathode shaft 53 are not interconnected at the location of the connection piece the cathode shaft properly abuts against the connection piece 55. In this way a solid mechanical contact between the cathode shaft 53 and the connection piece 55 is obtained. This enables the connection piece 55 to be secured to the cathode shaft 53 by means of three spaced laser welds one of which is shown at 62. A number of suspension wires 57, for example three, having a cross-section and a length of, for example, 30 μm and 600 μm, respectively, are secured to the head end of a heat reflection screen 56 (FIG. 7), the suspension wires being manufactured from a material having a low coefficient of thermal conduction between 40 and 60 $Wm^{-1}K^{-1}$ at approximately 1300° K. amongst others, an alloy of tungsten and 26% of rhenium can suitably be used for this purpose. For example, by means of melting a spherical portion 58 is provided at the free end of each suspension wire 57, the function of which spherical portion will be described hereinbelow.

Figure 8:
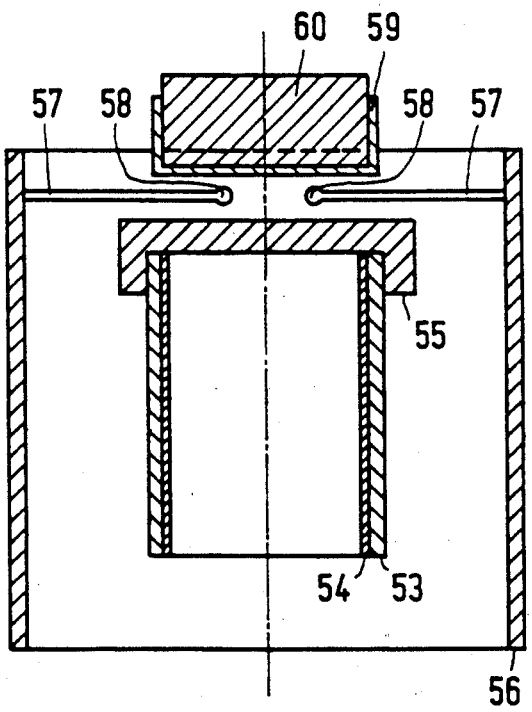
FIG. 8 shows the assembly of the cathode unit.

The cathode shaft 53 is suspended in the heat reflection screen 56 (see FIG. 8) by locating the holder 59 containing the electron-emitting material 60, and the connection piece 55 with the cathode shaft 53 secured thereto, in such a manner that they contact one another, the free ends 58 of the suspension wires 57 being located between the holder 59 and the connection piece 55.

Figure 9:
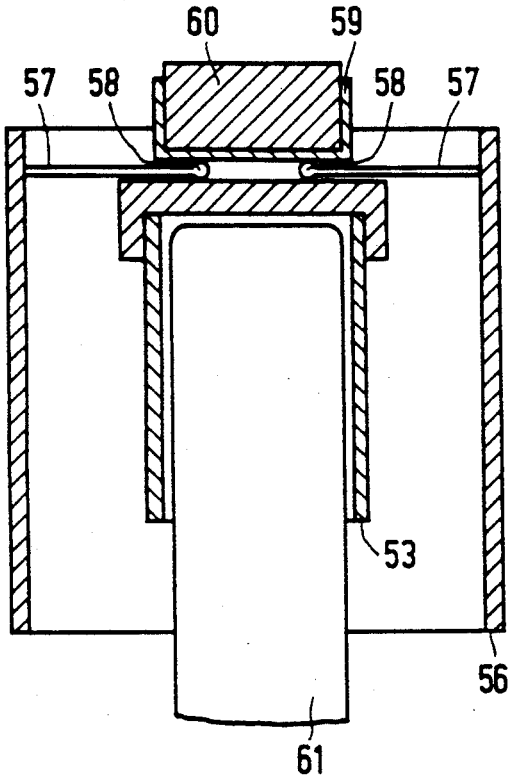
FIG. 9 shows how the cathode shaft is secured to the holder by means of a resistant weld and FIG. 10 is a diagrammatic sectional view of a detail of an electron gun, in accordance with the invention, having stretched suspension wires.

The holder 59 is secured to the connection piece 55, for example, by means of a resistance weld. To this end a weld electrode 61 is introduced into the cathode shaft 53, as shown in FIG. 9. In practice it has been found that a very satisfactory bond is obtained when the suspension wires 57 are previously provided with spherical portions 58. In practice it has been found that the sensitivity to vibrations of the final suspsnsion of the cathode shaft in tha heat reflection screen is optimally reduced when the extension of the suspension wires is approximately 5%.

Figure 10:
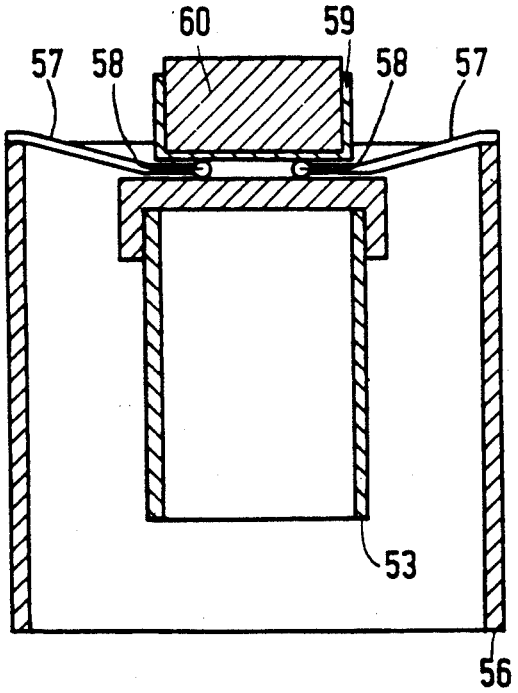

FIG. 10 diagrammatically shows a detail of an embodiment of an electron gun, in which the suspension wires 57 are secured to the edge of the heat-reflection screen 56. The holder 59 is located partly inside the heat-reflection scren 56 because during the manufacture of the electron gun, and after the holder 59 is secured to the cathode shaft 53, the cathode shaft 53 is pushed into the heat-reflection screen 56 until the suspension wires 57 are plastically deformed. By virtue hereof, not only the thermal efficiency is increased by the fact that the holder 59 is located partly inside the heat-reflection screen 56, but, in addition, the sensitivity to vibrations of the final suspension of the cathode shaft in the heat-reflection screen is also reduced as a result of the reduced elasticity of the suspension wires 57.

We claim:

1. An electron gun for generating an electron beam, comprising a cathode unit comprising a cathode shaft which is surrounded by a heat reflection screen, which cathode shaft is secured to a holder containing electron-emitting material having an emissive surface, characterized in that a connection piece is secured to the head end of the cathode shaft, the holder being provided on said connection piece and the cathode shaft being suspended in the heat reflection screen by suspension wires, a part of which is secured to the head end of the heat reflection screen, and another part is secured between the connection piece and the holder.

2. An electron gun as claimed in claim 1, characterized in that the holder of the electron-emitting material is located at least partly inside the heat reflection screen.

3. An electron gun as claimed in claim 1 or 2, characterized in that the cathode shaft is provided on the inside with a layer of aluminium having a thickness between 1 and 10 μm.

4. An electron gun as claimed in claim 1 or 2, characterized in that the wall of the connection piece has a larger thickness than that of the cathode shaft, and the connection piece is secured to the cathode shaft by means of laser welding.

5. An electron gun as claimed in claim 1, characterized in that the suspension wires are manufactured from a material having a coefficient of thermal conductivity between 40 and 60 $Wm^{-1}K^{-1}$ at approximately 1300° K.

6. An electron gun as claimed in claim 5, characterized in that the material is an alloy of tungsten and approximately 26% by weight of rhenium, an alloy of molybdenum and approximately 41% by weight of rhenium or an alloy of tantalum and neobium.

7. An electron gun as claimed in claim 1 or 2, characterized in that the cathode shaft, the connection piece and the holder consist essentially of molybdenum.

8. A method of manufacturing an electron gun comprising a cathode unit, in which a cathode shaft is suspended in a heat reflection screen and a holder containing electron-emitting material is secured to the head end of the cathode shaft, characterized in that a connection piece is secured to the head end of the cathode shaft, and in that the cathode shaft is suspended in the heat reflection screen by securing suspension wires to the head end of the heat reflection screen, contacting the connection piece and the holder in such a manner that parts of the suspension wires extend between the holder and the connection piece, and interconnecting the holder, the wire parts and the connection piece.

9. A method as claimed in claim 8, characterized in that the cathode shaft is formed by wrapping or forming a unilaterally aluminized foil around a mandrel, in such a manner that an at least partial overlap is obtained, and interconnecting the overlapping parts of the cathode shaft at the end of the cathode shaft facing away from the head end.

10. A method as claimed in claim 8 or 9, characterized in that after the holder has been connected to the connection piece the cathode shaft is pushed into the heat reflection screen until the suspension wires are plastically deformed.

11. A display tube comprising an electron gun as claimed in claim 1 or 2.

* * * * *